United States Patent [19]

Schlaefli

[11] 4,386,483

[45] Jun. 7, 1983

[54] METHOD AND APPARATUS FOR GRINDING CONVERGENT CONICAL SURFACES

[75] Inventor: Alfred Schlaefli, Neuchâtel, Switzerland

[73] Assignee: Voumard Machines Co. S.A., Neuchâtel, Switzerland

[21] Appl. No.: 235,503

[22] Filed: Feb. 18, 1981

[30] Foreign Application Priority Data

Feb. 27, 1980 [CH] Switzerland ..... 1580/80

[51] Int. Cl.[3] ..... B24B 1/00

[52] U.S. Cl. ..... 51/5 D; 51/88; 51/327

[58] Field of Search ..... 51/326, 327, 5 D, 5 R, 51/281 P, 290, 88

[56] References Cited

U.S. PATENT DOCUMENTS

| | | | |
|---|---|---|---|
| 2,440,148 | 0/0000 | Madison | 51/236 |
| 2,442,683 | 0/0000 | Green | 51/50 |
| 2,534,531 | 0/0000 | Rossmanith | 51/43 |
| 2,807,916 | 10/1957 | Squire | 51/3 |
| 3,924,355 | 12/1975 | Tatsumi | 51/3 |
| 4,265,054 | 5/1981 | Ito | 51/3 |
| 4,286,413 | 9/1981 | Axilsson | 51/3 |

FOREIGN PATENT DOCUMENTS

| | | |
|---|---|---|
| 2711613 | of 0000 | Fed. Rep. of Germany . |
| 1436769 | of 0000 | France . |
| 284532 | of 0000 | Switzerland . |
| 513474 | of 0000 | United Kingdom . |
| 822437 | of 0000 | United Kingdom . |

*Primary Examiner*—Harold D. Whitehead

*Attorney, Agent, or Firm*—LeBlanc, Nolan, Shur & Nies

[57] ABSTRACT

Two grinding-wheel spindles bearing grinding wheels are mounted on a table which undergoes an angular displacement for simultaneously grinding convergent internal and external conical surfaces of a workpiece, on the one hand, and for truing the grinding wheels by means of truing tools, on the other hand. The truing tools are so positioned that the grinding faces of the wheels are trued in a manner whereby the workpiece surfaces are then automatically ground with extreme precision and the exact desired diameter of the circular edge formed at the junction of the convergent surfaces is obtained.

12 Claims, 5 Drawing Figures

METHOD AND APPARATUS FOR GRINDING CONVERGENT CONICAL SURFACES

Figure 1:
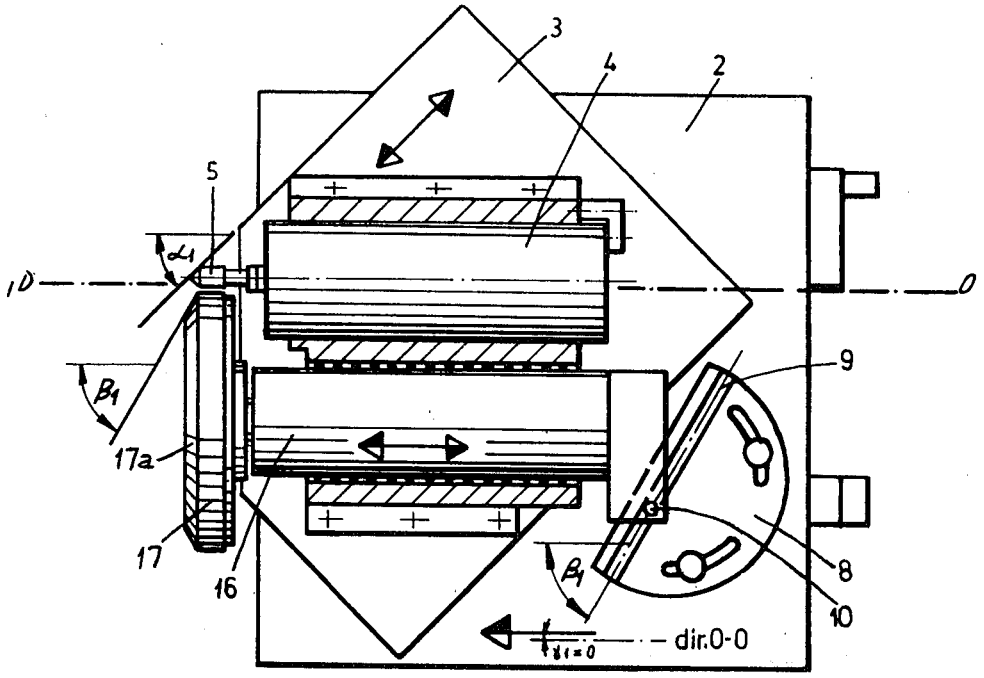

This invention relates to the grinding of tapered surfaces, and more particularly to a method and apparatus for grinding two conical surfaces, one internal and the other external, converging at the end of a workpiece to form a circular joining edge.

When a substantially socket-shaped part includes two conical surfaces, one internal and the other external, which meet at one end of the part, the junction between these two surfaces forms a circular edge. For certain applications, in particular for fuel-injection nozzles in internal combustion engines, these two surfaces must be very accurately ground, and the diameter of the circular joining edge must be very precise as well.

The methods and apparatus hitherto proposed for grinding such convergent conical surfaces involve two successive operations, one for internal grinding and another for external grinding. In order that all grinding operations may be carried out under the most favorable conditions, particularly as regards the requirements for concentricity of the various cylindrical and conical surfaces of revolution, it is important that the workpiece remains mounted on the same rotary driving device or that the transfer from one arrangement to another can be carried out in such a way that faultless centering and axial positioning are ensured. Moreover, despite the precision of the feed systems, the use of two successive operations for grinding the two conical surfaces involves a certain deviation between the results, and hence difficulty in obtaining a very precise diameter of the edge formed by the convergent surfaces.

It is an object of this invention to provide an improved method and apparatus for simultaneously grinding convergent conical surfaces which ensure more precise grinding of these surfaces and, at the same time, greater accuracy of the diameter of the edge they form, than has been possible with prior art methods and apparatus.

To this end, in the method according to the present invention, the improvement comprises the steps of mounting the workpiece on a rotary drive device; disposing in front of the end to be ground of the workpiece a first table displaceable in a direction defined by the angle formed by the first table with the axis of the workpiece; disposing on the first table a second table displaceable obliquely relative to the first table in a primary angular direction corresponding to the angle of taper desired for one of the conical surfaces of the workpiece; fixing a first grinding-wheel spindle, bearing a first conical or frustoconical grinding wheel, immovably to the second table so that the first grinding-wheel spindle is displaced together with the second table in the primary angular direction; mounting a second grinding-wheel spindle, bearing a second conical or frustoconical grinding wheel, on the second table in such a way that it is immovable relative to the second table in at least one direction; providing the second grinding-wheel spindle with means causing it to respond to a displacement of the second table in the primary angular direction by effecting an oblique movement in a secondary angular direction corresponding to the angle of taper desired for the other of the conical surfaces of the workpiece; positioning a first grinding-wheel truing tool associated with the first grinding wheel and a second grinding-wheel truing tool associated with the second grinding wheel relative to the axis of the workpiece in a manner suitably determined for obtaining the desired diameter of the circular joining edge of the workpiece, this diameter depending, for given angular values, solely upon the positions of the first and second grinding-wheel truing tools; setting the workpiece and the first and second grinding wheels in rotary motion; truing the first and second grinding wheels with the aid of the first and second grinding-wheel truing tools, respectively; causing the second table to move obliquely in the primary angular direction; and advancing the first table toward the workpiece and thereby causing the first and second grinding wheels to act simultaneously upon the end to be ground of the workpiece, the orientation of the advancing movement of the first table being such as to satisfy the equation $$(\alpha-\beta)\cdot\gamma=0$$

wherein $\alpha$ is the angle of taper corresponding to the primary angular direction, $\beta$ is the angle of taper corresponding to the secondary angular direction, and $\gamma$ is the angle formed by the direction of displacement of the first table with the axis of the workpiece.

In the apparatus according to the present invention, intended for carrying out the foregoing method, the improvement comprises a first table displaceable in a direction defined by the angle of orientation of the first table relative to the axis of the workpiece; a second table mounted on the first table and displaceable obliquely relative to the first table in a primary angular direction corresponding to a first angle of taper desired for a first one of the conical surfaces; a first grinding-wheel spindle fixedly mounted on the second table for movement with the second table in the primary angular direction; a second grinding-wheel spindle mounted on the second table to be immovable relative to the second table in at least one direction; means for causing the second grinding-wheel spindle to move, obliquely, in response to a displacement of the second table in the primary angular direction, in a secondary angular direction corresponding to a second angle of taper desired for a second one of the conical surfaces; a first grinding wheel mounted on the first grinding-wheel spindle; a second grinding wheel mounted on the second grinding-wheel spindle; and a first and a second grinding-wheel truing tool respectively associated with the first and second grinding wheels and occupying, when in operation, respective positions relative to the axis of the workpiece determined as a function of the first and second angles of taper, respectively, the mutual relation between the positions being determined as a function of the desired diameter of the circular joining edge.

In one embodiment of the invention, intended for grinding convergent conical surfaces having the same angle of taper, a considerable simplification can be achieved in that the grinding-wheel spindles are both immovably fixed to the table supporting them. It thus becomes possible to dispense with certain slide means used in the ordinary case when the two angles of taper are not equal.

Figure 2:
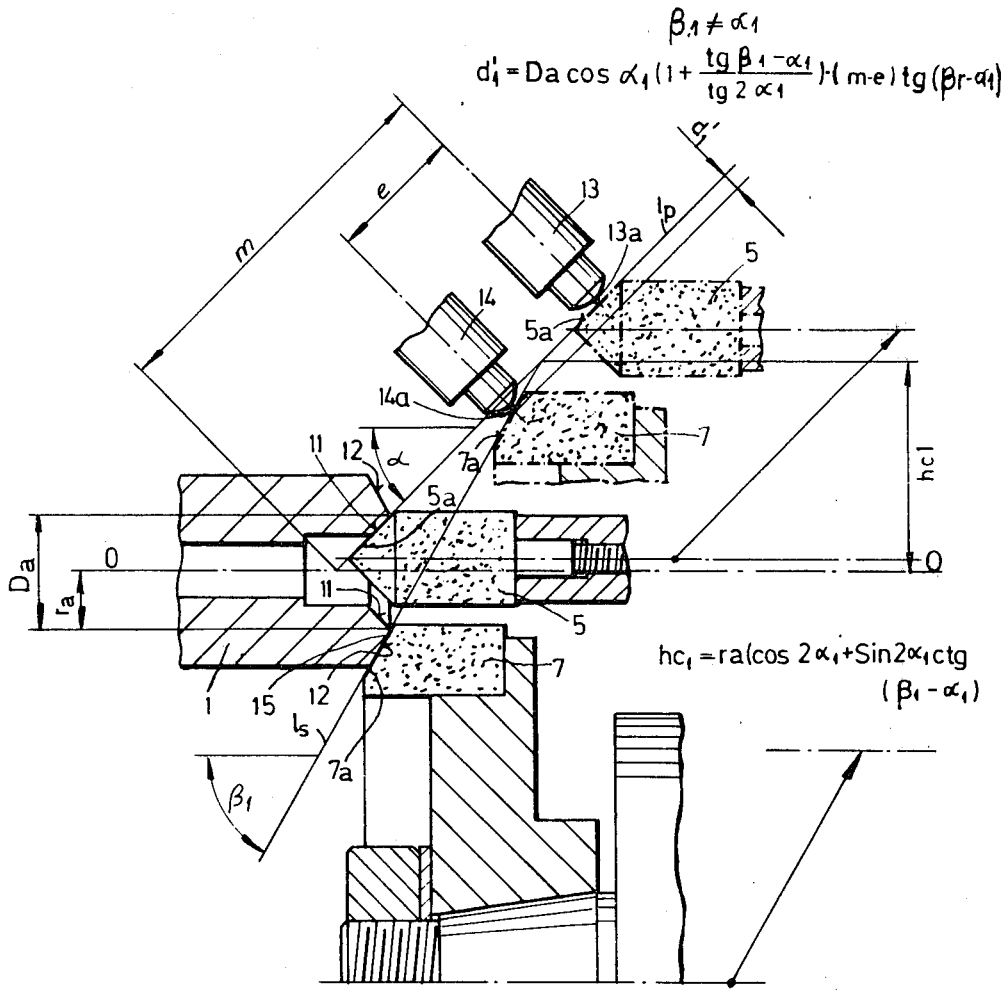
Figure 3:
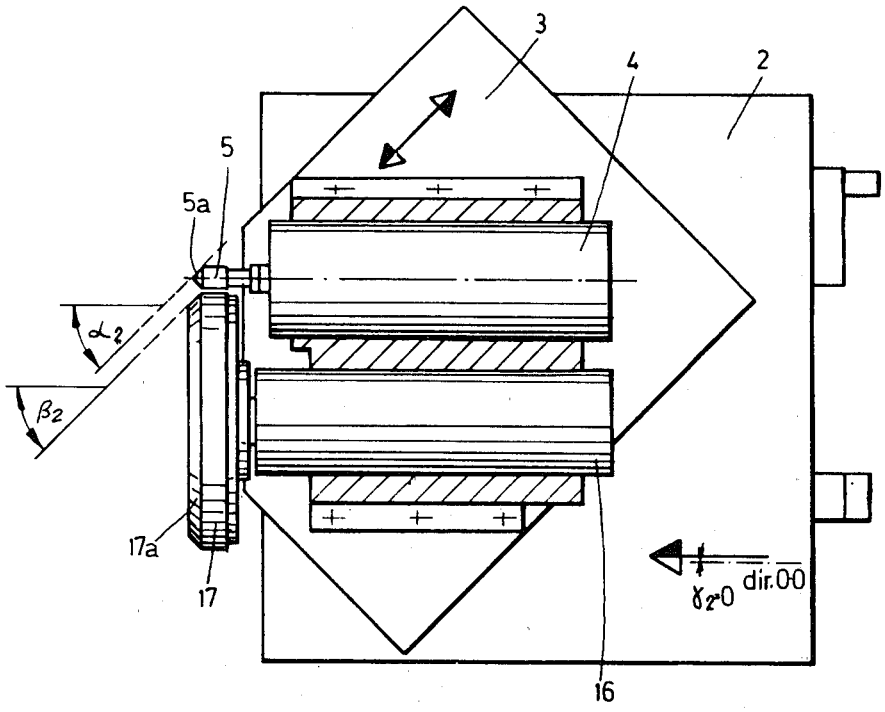
Figure 4:
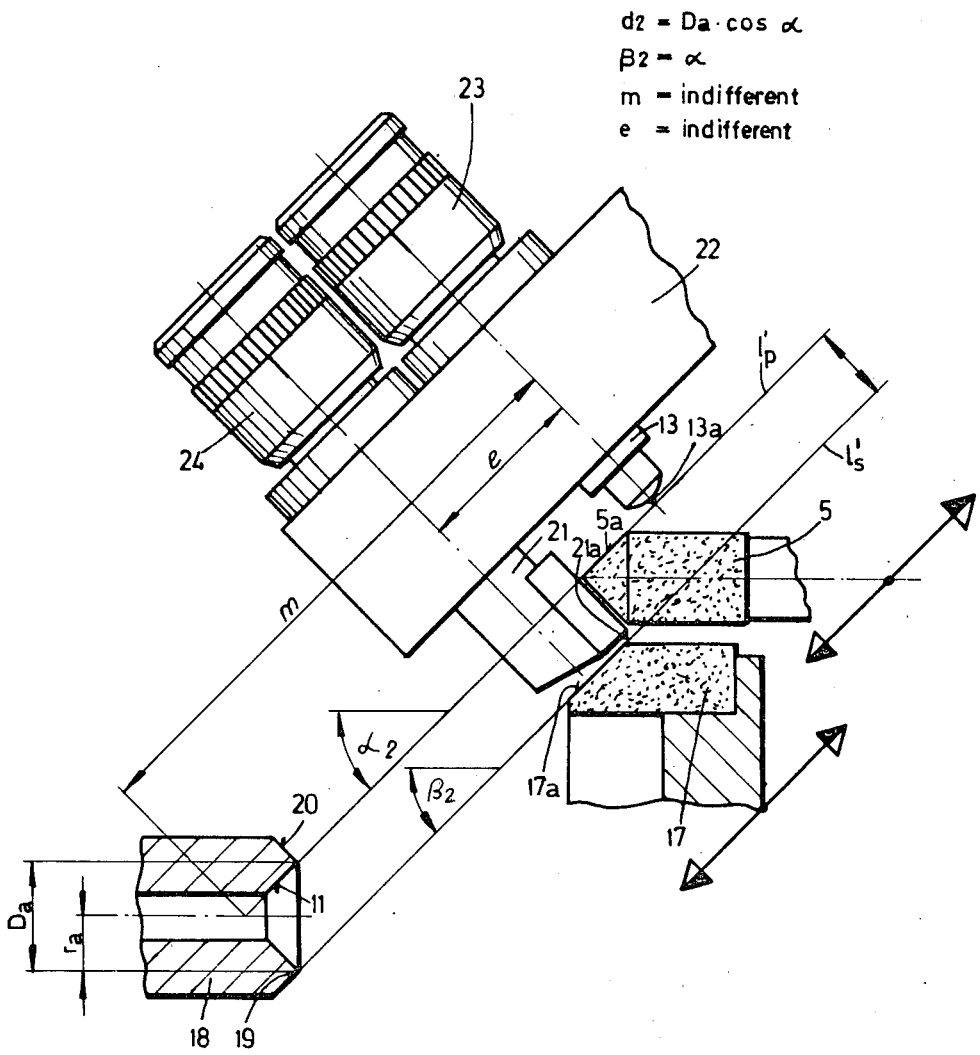
Figure 5:
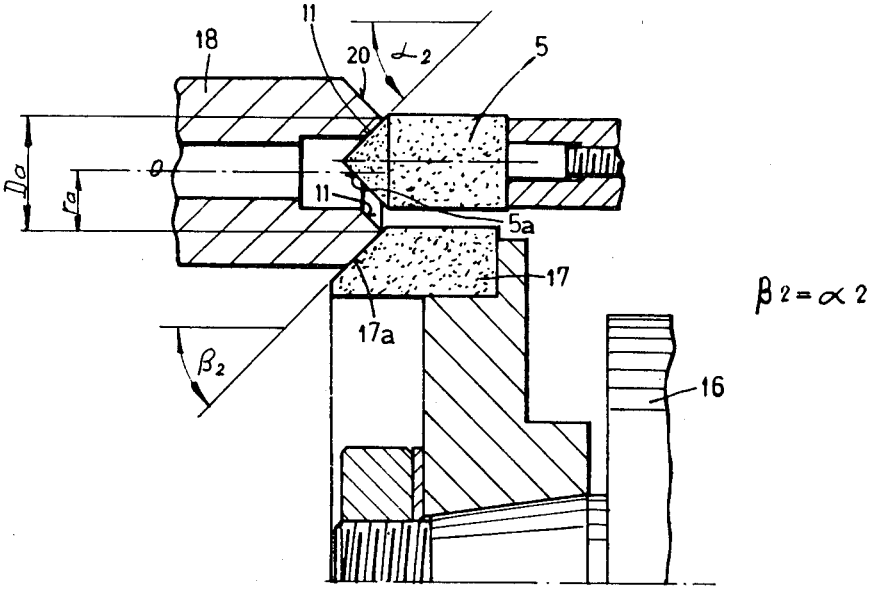

Other objects and advantages of the invention will become apparent from the following detailed description of two preferred embodiments thereof, taken in conjunction with the accompanying drawings, in which:

FIG. 1 is a diagrammatic plan view of apparatus suitable for carrying out the method of the invention whatever the angles of taper of the conical surfaces to be ground, these angles usually not being equal, FIG. 2 is a diagrammatic view serving to explain the operation of the apparatus of FIG. 1, FIG. 3 is a diagrammatic plan view of apparatus intended for carrying out the method of the invention when the angles of taper of the conical surfaces to be ground are equal, FIG. 4 is a diagrammatic view illustrating the manner in which the grinding wheels are trued in the method utilizing the apparatus of FIG. 3, and FIG. 5 is a diagrammatic view analogous to FIG. 4, showing the operation by which the two grinding wheels grind the conical surfaces when the apparatus of FIG. 3 is utilized.

The apparatus shown in FIG. 1 is a grinding-wheel support intended to be placed in front of the work spindle of a grinding machine. A workpiece 1 (shown in FIG. 2) is mounted on and rotatingly driven by a work spindle rotating about the axis O—O, in a manner known per se. FIG. 1 shows only the grinding-wheel support apparatus, which actually constitutes a grinding-machine accessory. The apparatus comprises a first table 2 which is mounted on a frame part or similar support (not shown) of the grinding machine. Table 2 is movable parallel to axis O—O of the grinding machine by appropriate means (not shown). The direction of displacement of table 2 might form a certain angle $\gamma$ with axis O—O instead. In the case of FIG. 1, therefore, this angle is zero ($\gamma_1=0$).

Table 2 bears a second table 3 displaceable on table 2 in an oblique direction called the primary angular direction $\alpha$, which in the embodiment illustrated in FIG. 1 corresponds to an angle $\alpha_1$. It will be seen below that this angle is closely connected with the grinding operation of the grinding machine and with an angle of taper of a ground surface. Angle $\alpha$ is preferably adjustable; in apparatus intended for continuous mass production of identical parts, angle $\alpha$ might be permanently fixed instead of being adjustable. Table 3 bears a first grinding-wheel spindle 4 fixed thereto so that the axis of rotation of spindle 4 is approximately parallel to axis O—O of the grinding machine. Such parallelism is not essential to proper operation, however, and as a modification the axis of grinding spindle 4 might form an angle with axis O—O. A grinding wheel 5 having a conical grinding face is fixed to the shaft of spindle 4. Grinding wheel 5, which is a small wheel, will be rotatingly driven by spindle 4 at a very high angular velocity.

Next to the first grinding-wheel spindle 4, the second table 3 bears a second grinding-wheel spindle 6, the axis of rotation of which is preferably parallel to that of spindle 4. Spindle 6 is mounted in such a way that it is immovable relative to table 3 in the direction perpendicular to axis O—O of the workpiece but slidable relative to table 3 in the direction parallel to axis O—O. A grinding wheel 7 having a frustoconical grinding face and very much larger than grinding wheel 5 is mounted on the shaft of the second grinding-wheel spindle 6. Wheel 7 is relatively large in diameter because its grinding face must come close to that of wheel 5, so that the radius of wheel 7 must be nearly equal to the distance between the axes of spindles 4 and 6. When table 3 moves obliquely relative to table 2 in primary direction $\alpha$, spindle 4 follows this movement exactly, whereas spindle 6 undergoes the same component of displacement in the direction perpendicular to axis O—O but a different movement in the direction parallel to axis O—O.

A directional guide device 8 is fixed to table 2 and comprises a slideway 9 which can, with guide device 8, be positioned relative to table 2 in various directions. An element 10, such as a stud, follower finger, or similar component free of play, fixed under the rear portion of the frame of spindle 6, enters slideway 9 so that the direction of the latter, forming an angle $\beta_1$ with axis O—O of the workpiece, is imparted to spindle 6 as its direction of displacement whenever spindle 6 is carried along by an oblique movement of table 3 relative to table 2.

Thus, an oblique movement of table 3 in primary direction $\alpha$ is expressed as a displacement of first spindle 4 and grinding wheel 5 in that same primary direction $\alpha$, and as a displacement of second spindle 6 with its grinding wheel 7 in an oblique direction determined by guide device 8, viz., in the present instance, secondary angular direction $\beta$, having the value $\beta_1$ as the apparatus is adjusted in FIG. 1.

Consequently, each of the grinding wheels 5 and 7 moves in its own angular direction, and it will therefore be seen that their conical or frustoconical grinding faces are trued according to these two directions $\alpha_1$, $\beta_1$.

The operation of the apparatus for simultaneously grinding two conical surfaces, one internal and the other external, at the end of workpiece 1, will now be explained with reference to FIG. 2.

In FIG. 2, workpiece 1 will be seen to have at the front end thereof two conical surfaces 11 and 12 to be ground, surface 11 being internal and surface 12 external. The angle of taper of internal surface 11 is angle $\alpha_1$, while that of external surface 12 is angle $\beta_1$. It will also be seen that conical grinding faces 5*a* and 7*a* of wheels 5 and 7 have the required taper for suitably grinding surfaces 11 and 12. The generatrices of faces 5*a* and 7*a* move along a primary base line $l_p$ and a secondary base line $l_s$, respectively. The angles formed by base lines $l_p$ and $l_s$ with axis O—O of workpiece 1 correspond to the primary and secondary angular directions, respectively, in which spindles 4 and 6 move (FIG. 1) when second table 3 is displaced obliquely on first table 2. It will be observed that primary and secondary base lines $l_p$ and $l_s$ intersect at a distance $hc_1$ from axis O—O; and this distance of intersection $hc_1$, in conjunction with primary and secondary angular direction angles $\alpha$ and $\beta$, is of great importance for obtaining the exact grinding dimensions of workpiece 1.

The required relationships concerning the positions and the lines of displacement of the generatrices of grinding faces 5*a* and 7*a* of the respective grinding wheels are ensured by the proper positioning of a first truing tool 13, associated with grinding wheel 5, and a second truing tool 14, associated with grinding wheel 7. The operative tips 13*a* and 14*a* of tools 13 and 14 must be situated on primary base line $l_p$ and on secondary base line $l_s$, respectively. Under these conditions, an oblique movement in primary angular direction $\alpha$ of table 3 relative to table 2 causes grinding wheels 5 and 7 to be trued in such a way that the generatrix of each will automatically occupy the required grinding position during operation. It will be understood that first table 2 will be longitudinally displaced for the purposes of transition from the truing operation to the grinding operation, of compensating for wear on the grinding wheels by truing them, and of ensuring the required grinding depth during operation. Truing tools 13 and 14 need not be positioned relative to workpiece 1 itself but rather by conforming to the geometric conditions set forth above (primary and secondary base lines $l_p$, $l_s$, respectively forming the required angles $\alpha$ and $\beta$ and intersecting at distance $hc_1$ from axis O—O).

It will be apparent that if there were not a well-defined correlation between the grinding of internal conical surface 11 and the grinding of external conical surface 12, the diameter of circular edge 15 formed at the junction of those two surfaces might vary. Now, in the case of workpiece 1, the length of this diameter $D_a$ of circular joining edge 15 must be established and maintained with very great precision, on the same order of magnitude as the precision obtained generally in grinding operations, i.e., on the order of one or several microns.

Diameter $D_a$ of edge 15 and angles of taper $\alpha_1$ and $\beta_1$ being given, primary and secondary base lines $l_p$ and $l_s$ must naturally have the required angles and must furthermore intersect at distance $hc_1$ from axis O—O, which distance is governed by the equation $$hc = r_a[\cos 2\alpha + \sin 2\alpha \cdot \cot(\beta - \alpha)],$$

wherein $r_a$ is the radius of the circumference formed by the joining edge of the conical surfaces to be ground, and angles $\alpha$ and $\beta$ are as described above. The indices have been omitted in this equation since it is intended to be applicable generally and not just to the geometric structural arrangement shown in FIG. 2.

As explained above, an oblique displacement of table 3 in primary angular direction $\alpha_1$ causes grinding faces 5*a* and 7*a* of wheels 5 and 7 to move along lines which, during the grinding operation, coincide exactly with the generatrices of conical surfaces 11 and 12 to be ground. Therefore, by means of table 3, grinding wheels 5 and 7 can be caused to effect stroke movements during the grinding operation, the grinding wheels "sliding" along their generatrices, thus producing a significantly better grinding finish.

In practice, truing tools 13 and 14 are fixed side by side at an angle to axis O—O with their axes substantially perpendicular to primary angular direction $\alpha_1$, the distance "e" between their axes preferably being a fixed value. Moreover, a distance "m" may be established, perpendicular to the axes of tools 13 and 14 and hence parallel to primary angular direction $\alpha_1$, between the axis of truing tool 13 and the point where baseline $l_p$ intersects axis 0-0 of workpiece 1 (and of the grinding machine). Under these conditions, in order to determine the proper position of truing tool 14—assuming that primary direction angle $\alpha_1$ has been previously established—tool 14 must be advanced perpendicular to primary base line $l_p$ until its tip 14*a* reaches a point on secondary base line $l_s$ at a distance $d'_1$ beyond line $l_p$. To satisfy this requirement, it suffices for distance $d'_1$ to meet the condition $$d' = D_a \cos\alpha \left[1 + \frac{\tan(\beta - \alpha)}{\tan 2\alpha}\right] - (m - e)\tan(\beta - \alpha),$$

wherein the quantities are as defined above, the indices again being omitted for the sake of generality.

It will be noted that if distance "m" were slightly increased as compared with what is shown in FIG. 2, tip 14*a* of truing tool 14 would be situated at the point of intersection of the two base lines and could even be positioned behind primary base ilne $l_p$, beyond that point of intersection. This arrangement would have the advantage of allowing the grinding wheels to be trued without having to retract the truing tools or withdraw the grinding-wheel assembly toward the rear in order to be able to put these wheels into a truing position from the grinding position. In the case illustrated in FIG. 2, it will be seen that in order to put wheels 5 and 7 from the grinding position (shown in solid lines) into the truing position (shown in dot-dash lines), either the grinding wheels or the truing tools must be moved back, for otherwise, grinding wheel 5 would strike against truing tool 14 on its way toward truing tool 13. This drawback could be overcome by increasing distance "m". As a modification, provided the difference between angles $\alpha$ and $\beta$ is on the order of that shown in FIG. 2, truing tools 13 and 14 might be permanently positioned with their tips 13*a* and 14*a* situated on base line $l_p$ by altering distance "m" to place tip 14*a* at the point of intersection of base lines $l_p$ and $l_s$ so that it is on line $l_s$ as well, where it should be.

FIGS. 3, 4 and 5 illustrate a modification of the apparatus for a particular machining situation in which numerous simplifications are possible. In these three drawing figures, those parts which are identical to parts of the embodiment shown in FIGS. 1 and 2 are designated by the same reference characters.

This simplified embodiment is intended for use when the two conical surfaces to be ground have the same angle of taper ($\alpha_2 = \beta_2$).

Again to be found in this second embodiment are first table 2, movable axially, i.e., in a direction forming an angle $\gamma_2 = 0$ with the axis of the workpiece; second table 3, movable obliquely in the aforementioned primary angular direction ($\alpha_2$); and first grinding-wheel spindle 4 fixed to table 3 and bearing small conical grinding wheel 5.

Not to be found, on the other hand, is guide device 8, 9, 10; and a second grinding-wheel spindle 16 is here immovably fixed to table 3 as well. Furthermore, spindle 16 bears a grinding wheel 17 having a frusto-conical grinding face 17*a* with the same taper as conical grinding face 5*a* of wheel 5. A workpiece 18 has a conical internal surface 11 similar to that of workpiece 1 in the first embodiment, but it differs from the latter in that its conical external surface 20 has the same angle of taper as its internal surface 11. In other words, the primary and secondary angular directions are identical, i.e., $\alpha_2 = \beta_2$. This embodiment is considerably more advantageous inasmuch as it does without slide means for the second grinding-wheel spindle and oblique guide means specific to the latter. In this embodiment there is no point of intersection between base lines $l'_p$ and $l'_s$, or to be precise, this point of intersection would be situated in infinity (since $\beta = \alpha$, $\cot[\beta - \alpha] = \infty$). The two base lines are parallel and are separated by a distance $d_2$ which likewise represents the distance by which the tip 21*a* of a second truing tool 21 must advance beyond base line $l'_p$, i.e., beyond tip 13*a* of truing tool 13. In FIG. 4, the truing tools are depicted in a more technological manner, being mounted on a truing-tool head 22. Knobs 23 and 24 are provided for adjusting the positions of operative tips 13*a* and 21*a* of truing tools 13 and 21 perpendicular to base line $l'_p$.

It will be noted that in this embodiment, distances "m" and "e" play no part in determining distance $d_2$ between the tips of the truing tools, perpendicular to the base lines. Hence it is no longer possible to obviate retraction of the truing tools or temporary withdrawal of the spindles for reaching the truing position from the grinding position by increasing the length of distance "m" inasmuch as distance $d_2$ remains constant whatever the length of distance "m". In the embodiment illustrated in FIGS. 3–5, the direction of displacement of first table 2 need not necessarily be parallel to the axis of workpiece 18, i.e., to the axis of the work spindle of the grinding machine. Depending upon the grinding-wheel configurations and the various ancillary conditions, an angle $\gamma$ not equal to zero may be provided between the axis of the workpiece and the direction of displacement of table 2. The general condition which must in any case be met is $(\alpha-\beta)\cdot\gamma=0$.

As in the first embodiment, a stroke movement may advantageously be imparted to the grinding wheels during the grinding operation by reciprocating table 3 in its oblique direction of displacement (the common primary and secondary angular direction).

It should further be noted that, depending upon the grinding-wheel shapes and the circumstances, it may prove advantageous to dispose the axes of the grinding-wheel spindles at an angle to the axis of the workpiece, particularly when the angle of taper is very slight; such positioning will than allow the use of a somewhat less fragile grinding wheel for grinding the internal conical surface.

Grinding wheel 5, of a very small size, naturally rotates at the highest speed possible considering the characteristics of the grinding spindle; grinding wheel 17 (like wheel 7 in the first embodiment), being of larger diameter, obviously rotates more slowly.

In the event that diamond-bonded cutters (diamond-bonding truing-wheels) are used instead of diamond-tipped tools as the truing tools in embodiments of this invention, as may often be the case, the entire operative edge face of the cutter must be situated on the appropriate base line ($l_p$ or $l_s$).

The novel concept of the present invention is embodied not only in the apparatus described but also, and even primarily, in the grinding method by which two grinding-wheels simultaneously grind an internal conical surface and an external conical surface at one end of a workpiece. While in the foregoing specification embodiments of the invention have been set forth in considerable detail for purposes of making a complete disclosure thereof, it will be apparent to those skilled in the art that numerous changes may be made in certain details without departing from the spirit and principles of the invention.

What is claimed is:

1. A method of simultaneously grinding two conical surfaces, one internal and the other external, converging at one end of a workpiece where they form a circular joining edge, comprising the steps of:

mounting the workpiece on a rotary drive device;

disposing in front of the end to be ground of the workpiece a first table displaceable in a direction defined by the angle formed by the first table with the axis of the workpiece;

disposing on the first table a second table displaceable obliquely relative to the first table in a primary angular direction corresponding to the angle of taper desired for one of the conical surfaces of the workpiece;

fixing a first grinding-wheel spindle, bearing a first conical or frustoconical grinding wheel immovably to the second table so that the first grinding-wheel spindle is displaced together with the second table in the primary angular direction;

mounting a second grinding-wheel spindle, bearing a second conical or frustoconical grinding wheel, on the second table in such a way that it is immovable relative to the second table in at least one direction;

providing the second grinding-wheel spindle with means causing it to respond to a displacement of the second table in the primary angular direction by effecting an oblique movement in a secondary angular direction corresponding to the angle of taper desired for the other of the conical surfaces of the workpiece;

positioning a first grinding-wheel truing tool associated with the first grinding wheel and a second grinding-wheel truing tool associated with the second grinding wheel relative to the axis of the workpiece in a manner suitably determined for obtaining the desired diameter of the circular joining edge of the workpiece, this diameter depending, for given angular values, solely upon the positions of the first and second grinding wheel truing tools;

setting the workpiece and the first and second guiding wheels in rotary motion; truing the first and second grinding wheels with the aid of the first and second grinding-wheel truing tools at a first position, respectively;

thereafter causing the second table to move obliquely in the primary angular direction to a second position to bring the first and second grinding wheels into simultaneous contact with said workpiece during grinding; and advancing the first table toward the workpiece and thereby causing the first and second grinding wheels to act simultaneously upon the end to be ground of the workpiece, the orientation of the advancing movement of the first table being such as to satisfy the equation $$(\alpha-\beta)\cdot\gamma=0,$$

wherein $\alpha$ is the angle of taper corresponding to the primary angular direction, $\beta$ is the angle of taper corresponding to the second angular direction, and $\gamma$ is the angle formed by the direction of displacement of the first table with the axis of the workpiece.

2. A method of simultaneously grinding two conical surfaces, one internal and the other external, converging at one end of an annular workpiece where they form a circular joining edge, comprising the steps of:

mounting the workpiece on a rotary drive device;

disposing in front of the end of the workpiece a first table displaceable towards said end of the workpiece in a direction defined by an angle $\gamma$, which may also be zero, relative to the axis of the workpiece;

disposing on the first table a second table displaceable obliquely relative to the first table in a primary angular direction corresponding to the angle $\alpha$ of taper desired for one of the conical surfaces of the workpiece;

fixing a rotatably mounted first grinding wheel spindle bearing a first conical or frustoconical grinding wheel, immovably to the second table so that the first grinding wheel spindle is displaced together with the second table in the primary angular direction;

mounting a second grinding wheel spindle, bearing a second conical or frustoconical grinding wheel, on the second table in such a way that it is immovable relative to the second table in at least the direction perpendicular to the axis of the workpiece;

providing the second grinding wheel spindle with means causing it to maintain the movement of the second grinding wheel face along a predetermined line positioned relative to the primary angular direction, which line corresponds to the angle $\beta$ of taper desired for the other of the conical surfaces of the workpiece;

positioning a first grinding wheel truing tool associated with the first grinding wheel and a second grinding wheel truing tool associated with the second grinding wheel relative to the axis of the workpiece in a manner suitably determined for obtaining the desired diameter of the circular joining edge of the workpiece;

setting the workpiece and the first and second grinding wheels in rotary motion;

truing the first and second grinding wheels with the aid of the first and second grinding wheel truing tools at a first position, respectively;

thereafter causing the second table to move obliquely in the primary angular direction to a second position to bring the first and second grinding wheels into simultaneous contact with said workpiece during grinding; and advancing the first table toward the workpiece and thereby causing the first and second grinding wheels to act simultaneously upon the end to be ground of the workpiece, the orientation of the advancing movement of the first table being such as to satisfy the equation $$(\alpha-\beta)\cdot\gamma=0,$$

wherein $\alpha$ is the angle of taper corresponding to the primary angular direction, $\beta$ is the angle of taper corresponding to the predetermined line of movement of the second grinding wheel face, and $\gamma$ is the angle formed by the direction of displacement of the first table with the axis of the workpiece.

3. The method of claim 2, wherein the step of providing the second grinding wheel spindle with means causing it to maintain the movement of the second grinding wheel face along a predetermined line is carried out by provisions of means causing the second grinding wheel spindle to respond to a displacement of the second table in the primary angular direction by effecting an oblique movement along the predetermined line which corresponds to the angle of taper desired for the other of the conical surfaces of the workpiece.

4. The method of claim 2, further comprising the step of imparting to the second table a reciprocating movement along the primary angular direction during the grinding operation.

5. The method of claim 2 for grinding conical surfaces having the same angle of taper, further comprising the steps, for mounting the second grinding-wheel spindle in such a way that the movement thereof relative to the first table takes place in the desired angular direction, of fixing the second grinding-wheel spindle completely immovably to the second table; positioning the first and second grinding-wheel truing tools in such a way that, in operating position, the operative tips thereof are respectively situated on two oblique, parallel lines forming with the axis of the workpiece an angle equal to the common angle of taper of the two conical surfaces to be ground, the distance between the two oblique, parallel lines being governed by the equation $$d=D_a\cos\alpha,$$

wherein d is the said distance, $D_a$ is the diameter of the circular joining edge, and $\alpha$ is the angle of taper common to the two conical surfaces to be ground; and placing the second grinding-wheel truing tool closer to the axis of the workpiece than the first grinding-wheel truing tool, with the operative tip of the second grinding-wheel truing tool on whichever of the oblique, parallel lines intersects the axis of the workpiece more remotely from the workpiece.

6. Apparatus for simultaneously grinding two conical surfaces, one internal and the other external, converging at one end of a workpiece where said surfaces form a circular joining edge, comprising:

a first table displaceable in a direction defined by the angle of orientation of said first table relative to the axis of said workpiece;

a second table mounted on said first table and displaceable obliquely relative to said first table in a primary angular direction corresponding to a first angle of taper desired for a first one of said conical surfaces;

a first grinding-wheel spindle fixedly mounted on said second table for movement with said second table in said primary angular direction;

a second grinding-wheel spindle mounted on said second table to be immovable relative to said second table in at least one direction;

means for causing said second grinding-wheel spindle to move obliquely, in response to a displacement of said second table in said primary angular direction corresponding to a second angle of taper desired for a second one of said conical surfaces;

a first grinding wheel mounted on said first grinding-wheel spindle;

a second grinding wheel mounted on said second grinding-wheel spindle;

a first and a second grinding-wheel truing tool respectively associated with said first and second grinding wheels and occupying, when in operation, respective positions relative to the axis of said workpiece determined as a function of said first and second angles of taper, respectively, the mutual relation between said positions being determined as a function of the desired diameter of said circular joining edge; and said first and second grinding wheels displaceable obliquely by movement of said second table from contact with said first and second truing tools into grinding contact with said workpiece.

7. The apparatus of claim 6 intended for grinding conical surfaces having differing angles of taper, further comprising slide means enabling said second grinding-wheel spindle to slide on said second table in a direction parallel to the axis of said workpiece, wherein said angle of orientation of said first table is equal to zero, said first and second grinding-wheel spindles being disposed with their axes substantially parallel to the axis of said workpiece, said second grinding-wheel spindle being immovable relative to said second table in a direction perpendicular to the axis of said workpiece, and said means for causing said second grinding-wheel spindle to move obliquely including a guiding device slidable without play and connecting said second grinding-wheel spindle to said first table, whereby said second grinding-wheel spindle is movable relative to said first table only in said secondary angular direction.

8. The apparatus of claim 7, wherein said primary angular direction corresponds to the angle of taper desired for the internal conical surface to be ground, said first and second grinding-wheel truing tools each including an operative tip situated on a respective one of two respective oblique convergent lines lying in a plane passing through the axis of said workpiece, one of said convergent lines being a primary base line inclined to the axis of said workpiece at an angle corresponding to said primary angular direction and the other of said convergent lines being a secondary base line inclined to the axis of said workpiece at an angle corresponding to said secondary angular direction, and said convergent lines being so situated relative to one another as to intersect at a point separated from the axis of said workpiece by a distance satisfying the equation $$hc = \frac{D_a}{2}\,[\cos 2\alpha + \sin 2\alpha \cdot \cot(\beta - \alpha)],$$

wherein hc is said distance between said axis and said point of intersection, $D_a$ is the desired diameter of said circular joining edge, $\alpha$ is the angle of inclination of said primary base line, and $\beta$ is the angle of inclination of said secondary base line.

9. The apparatus of claim 8, wherein said operative tip of said first grinding-wheel truing tool is situated on said primary base line and said operative tip of said second grinding-wheel truing tool is situated on said secondary base line, said second grinding-wheel truing tool being adjustable or adjusted in a direction perpendicular to said primary base line, a first constant distance being maintained along said primary base line between the point at which said operative tip of said first grinding wheel truing tool is situated and the point on said primary base line opposite the point where said operative tip of said second grinding-wheel truing tool is situated on said secondary base line, a second constant distance being maintained along said primary base line between the point at which said operative tip of said first grinding-wheel truing tool is situated and the point of intersection of said primary base line with the axis of said workpiece, and said operative tip of said second grinding-wheel truing tool being disposed on said secondary base line at a predetermined distance from said primary base line satisfying the equation $$d' = D_a \cos\alpha \left[1 + \frac{\tan(\beta - \alpha)}{\tan 2\alpha}\right] - (m - e)\tan(\beta - \alpha),$$

wherein d' is said predetermined distance, $D_a$ is the desired diameter of said circular joining edge, m is said second constant distance, e is said first constant distance, $\alpha$ is the angle corresponding to said primary angular direction, which is likewise said angle of inclination of said primary base line, and $\beta$ is the angle corresponding to said secondary angular direction, which is likewise said angle of inclination of said secondary base line.

10. The apparatus of one of the claims 6 to 9, further comprising means for causing said second table to effect a reciprocating motion when said first and second grinding wheels are in grinding position.

11. The apparatus of claim 6 intended for grinding two conical surfaces having the same angle of taper, wherein said means for causing said second grinding-wheel spindle to move obliquely in said secondary angular direction comprises a mounting fixing said second grinding-wheel spindle immovably to said second table, said secondary angular direction being identical to said primary angular direction.

12. The apparatus of claim 11, wherein said first and second grinding-wheel truing tools are positioned, in operation, with said operative tips thereof respectively situated on two parallel oblique lines forming with the axis of said workpiece an angle equal to said angle of taper common to said two conical surfaces, said two parallel oblique lines being spaced from one another by a spacing distance satisfying the equation $$d = D_a \cos\alpha,$$

wherein d is said spacing distance, $D_a$ is the diameter of said circular joining edge, and $\alpha$ is said angle of taper common to said conical surfaces to be ground, said second grinding-wheel truing tool being situated closer to said axis of said workpiece than said first grinding-wheel truing tool on whichever of said two parallel oblique lines intersects said axis at a more remote point from said workpiece.

* * * * *